US008144072B2

(12) United States Patent
Chiang et al.

(10) Patent No.: US 8,144,072 B2
(45) Date of Patent: Mar. 27, 2012

(54) MULTI-BAND ANTENNA FOR NOTEBOOK COMPUTER

(75) Inventors: Chi-Ming Chiang, Pa-Te (TW); Daniel Chang, Pa-Te (TW); Shih-Chi Lai, Pa-Te (TW)

(73) Assignee: Auden Techno Corp., Pa-Te, Tao-Yuan Hsien (TW)

( * ) Notice: Subject to any disclaimer, the term of this patent is extended or adjusted under 35 U.S.C. 154(b) by 477 days.

(21) Appl. No.: 12/535,605

(22) Filed: Aug. 4, 2009

(65) Prior Publication Data

US 2011/0032170 A1 Feb. 10, 2011

(51) Int. Cl.
*H01Q 1/24* (2006.01)
*H01Q 1/38* (2006.01)

(52) U.S. Cl. ..... 343/860; 343/702; 343/700 MS

(58) Field of Classification Search ..... 343/702, 343/700 MS, 745, 846, 828, 829, 831, 860
See application file for complete search history.

(56) References Cited

U.S. PATENT DOCUMENTS

| | | | | |
|---|---|---|---|---|
| 7,450,076 | B1 * | 11/2008 | Lin et al. | 343/702 |
| 7,557,759 | B2 * | 7/2009 | Lin et al. | 343/702 |
| 2010/0194654 | A1 * | 8/2010 | Chiang | 343/750 |
| 2011/0012789 | A1 * | 1/2011 | Yang et al. | 343/700 MS |

* cited by examiner

*Primary Examiner* — Jacob Y Choi
*Assistant Examiner* — Hasan Islam
(74) *Attorney, Agent, or Firm* — Guice Patents PLLC

(57) ABSTRACT

A multi-band antenna includes an insulative carrier board arranged on the top side of the display screen of a notebook computer, a main antenna which has the top metal strip thereof disposed at the top edge of the insulative carrier board and the grounding metal strip thereon arranged on the insulative carrier board, an inverted L antenna arranged on the insulative carrier board, a first capacitor, a second capacitor, an antenna feed-in terminal and/or an inductor set between the inverted L antenna and the main antenna to achieve optimal matching subject to adjustment of the capacitance values of the first and second capacitors and the inductance value and position of the inductor.

10 Claims, 8 Drawing Sheets

MULTI-BAND ANTENNA FOR NOTEBOOK COMPUTER

BACKGROUND OF THE INVENTION

1. Field of the Invention

The present invention relates to an antenna for notebook computer and more particularly, to a multi-band antenna that has capacitor/inductor means built therein for impedance matching adjustment.

2. Description of the Related Art

Following fast development of wireless communication technology, mobile electronic apparatus must be equipped with a multi-band antenna for working at different frequencies. It is the mainstream to use a multi-band metal planar antenna in a cell phone or notebook computer for receiving or transmitting radio signals.

Conventionally, a metal planar antenna is connected to a circuit board in a mobile electronic apparatus through a SMT (Surface Mount Technology) component. Regular SMT components are designed having fixed impedance standards so that a matching antenna requires a matching circuit to regulate capacitance and inductance values. Using an antenna with a matching circuit complicates the design of the antenna and limiting the bandwidth and efficiency of the antenna. An improvement in this regard is necessary.

Accordingly, there is a strong need to provide an antenna structure that has a small size and allows adjustment of the working frequency to achieve impedance matching.

SUMMARY OF THE INVENTION

The present invention has been accomplished under the circumstances in view. It is the main object of the present invention to provide a multi-band antenna for notebook computer that has a small size and is practical for working at different frequencies. It is another object of the present invention to provide a multi-band antenna for notebook computer that has capacitor/inductor means for optimal matching adjustment.

To achieve these and other objects of the present invention, a multi-band antenna comprises an insulative carrier board arranged on the top side of the display screen of a notebook computer, a main antenna which has the top metal strip thereof disposed at the top edge of the insulative carrier board and the grounding metal strip thereon arranged on the insulative carrier board, an inverted L antenna arranged on the insulative carrier board, a first capacitor, a second capacitor, and an antenna feed-in terminal and/or an inductor arranged on the insulative carrier board and set between the inverted L antenna and the main antenna to achieve optimal matching subject to adjustment of the capacitance values of the first and second capacitors and the inductance value and position of the inductor.

DETAILED DESCRIPTION OF THE PREFERRED EMBODIMENT

Figure 1:
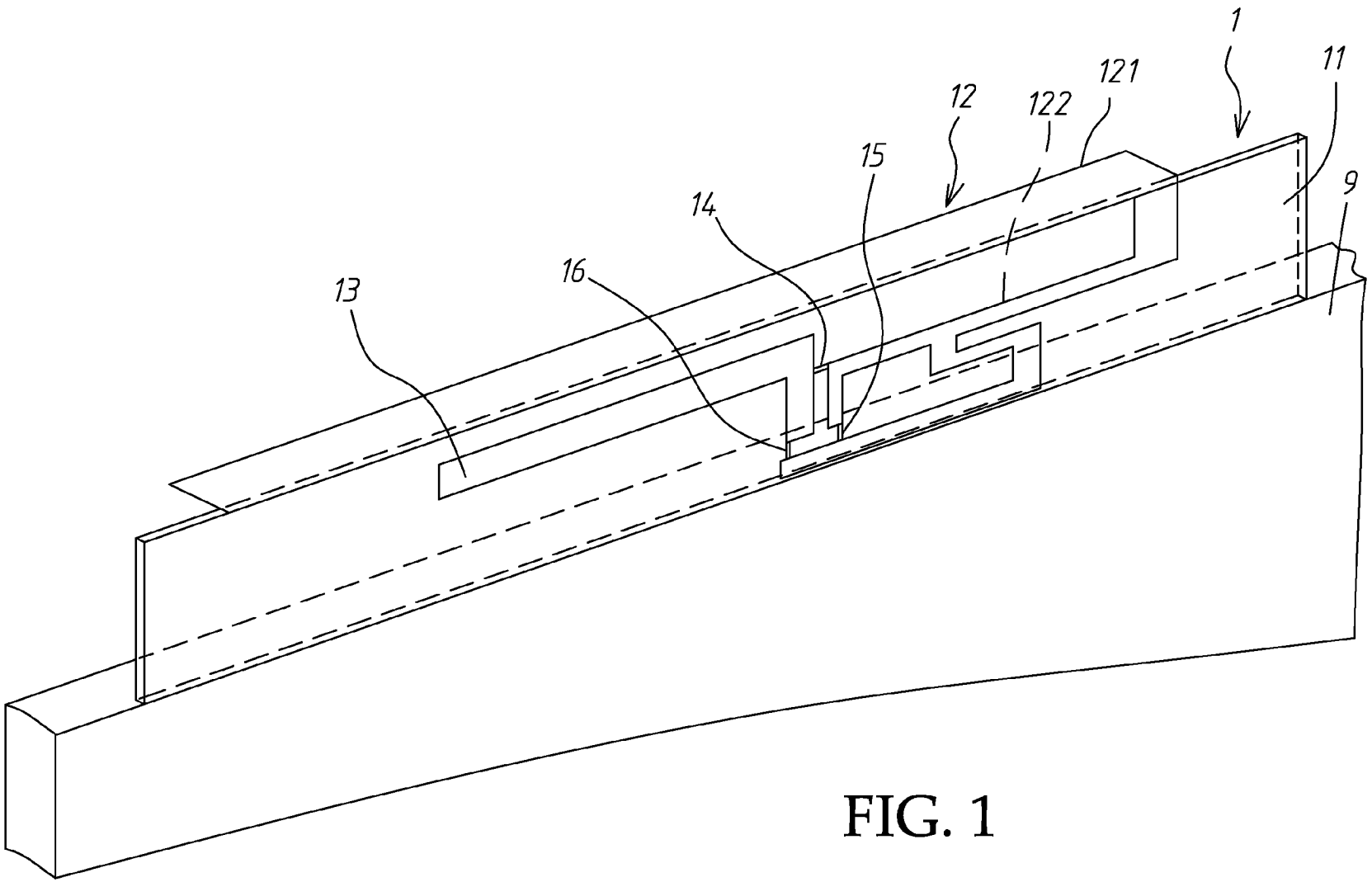
FIG. 1 is a perspective view showing a multi-band antenna installed in a display screen for notebook computer in accordance with a first embodiment of the present invention.

Referring to FIG. 1, a multi-band antenna 1 in accordance with a first embodiment of the preset invention is shown mounted on the top side of a notebook computer's display screen 9 for receiving and transmitting radio signals. The multi-band antenna 1 comprises an electrically insulative carrier board 11, a main antenna 12, an inverted L antenna 13, a first capacitor 14, a second capacitor 15 and an antenna feed-in terminal 16.

Figure 2:
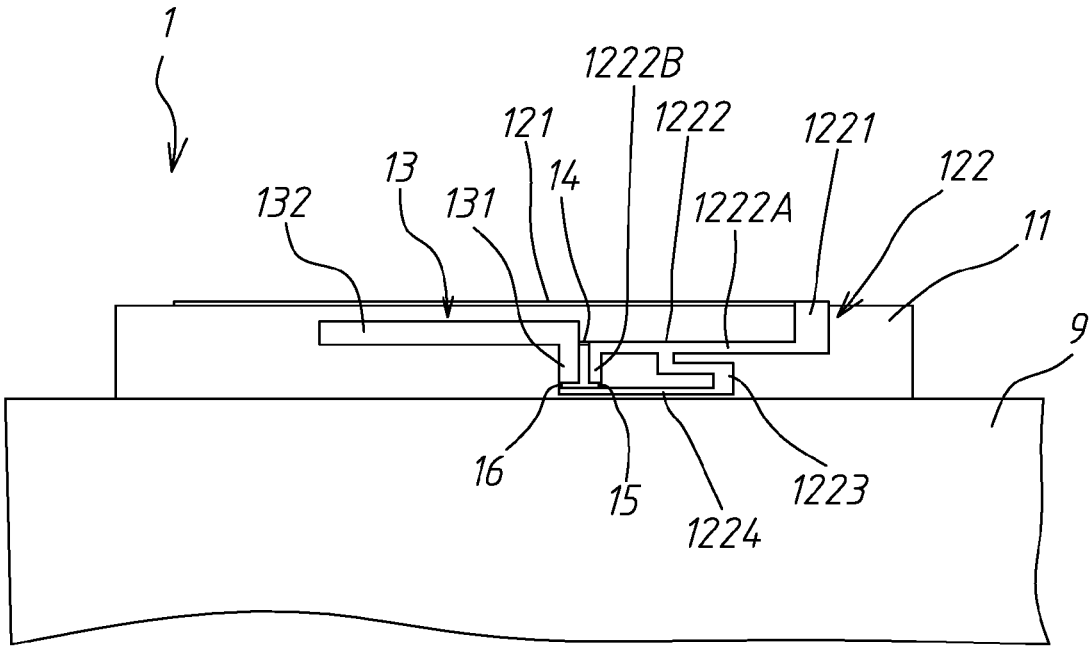
FIG. 2 is a plain view of the multi-band antenna in accordance with the first embodiment of the present invention.

Referring to FIGS. 1 and 2 again, the main antenna 12 comprises a top metal strip 121 and a grounding metal strip 122. The top metal strip 121 is disposed at the top side of the electrically insulative carrier board 11. The grounding metal strip 122 is arranged on the electrically insulative carrier board 11, having a top end portion 1221 connected to the top metal strip 121, a L-shaped body portion 1222 extended from one end of the top end portion 1221 remote from the top metal strip 121, a curved portion 1223 extended from a middle part of the longitudinal axis 1222A of the L-shaped body portion 1222 and a grounding portion 1224 extended from one end of the curved portion 1223 remote from the L-shaped body portion 1222 and connected to the display screen 9 and grounded. The display screen 9 serves as a grounding plane.

The inverted L antenna 13 is also arranged on the electrically insulative carrier board 11, having the transverse axis 131 thereof disposed at one lateral side relative to the transverse axis 1222B of the L-shaped body portion 1222 of the grounding metal strip 122 of the main antenna 12 at one lateral side and the longitudinal axis 132 thereof kept in parallel to the top metal strip 121 of the main antenna 12.

The first capacitor 14 is electrically connected between the transverse axis 131 of the inverted L antenna 13 and the transverse axis 1222B of the L-shaped body portion 1222 of the grounding metal strip 122 of the main antenna 12. The second capacitor 15 is electrically connected between the distal end of the transverse axis 1222B of the L-shaped body portion 1222 of the grounding metal strip 122 of the main antenna 12 and the transverse axis 131 of the grounding portion 1224 of the grounding metal strip 122 of the main antenna 12. The antenna feed-in terminal 16 is located on the distal end of the transverse axis 131 of the inverted L antenna 13.

During operation of the multi-band antenna 1, a radio signal is inputted through the antenna feed-in terminal 16 into the inverted L antenna 13 and then transferred by the first capacitor 14 to the distal end of the longitudinal axis 1222A of the L-shaped body portion 1222 of the grounding metal strip 122 of the main antenna 12.

It is to be understood that the first capacitor 14 and the second antenna 15 can match the antenna. Further, the position of the first capacitor 14 is vertically adjustable to match the multi-band antenna 1.

Further, in the multi-band antenna 1, the connection between the top end of the curved portion 1223 of the grounding metal strip 122 of the main antenna 12 and the longitudinal axis 1222A of the L-shaped body portion 1222 is movable to match the multi-band antenna 1 for inductance grounding.

Further, by means of adjusting the capacitance values and positions of the first capacitor 14 and second capacitor and the connection location between the top end of the curved portion 1223 and the longitudinal axis 1222A of the L-shaped body portion 1222, optimal matching of the multi-band antenna 1 is achieved.

Figure 3:
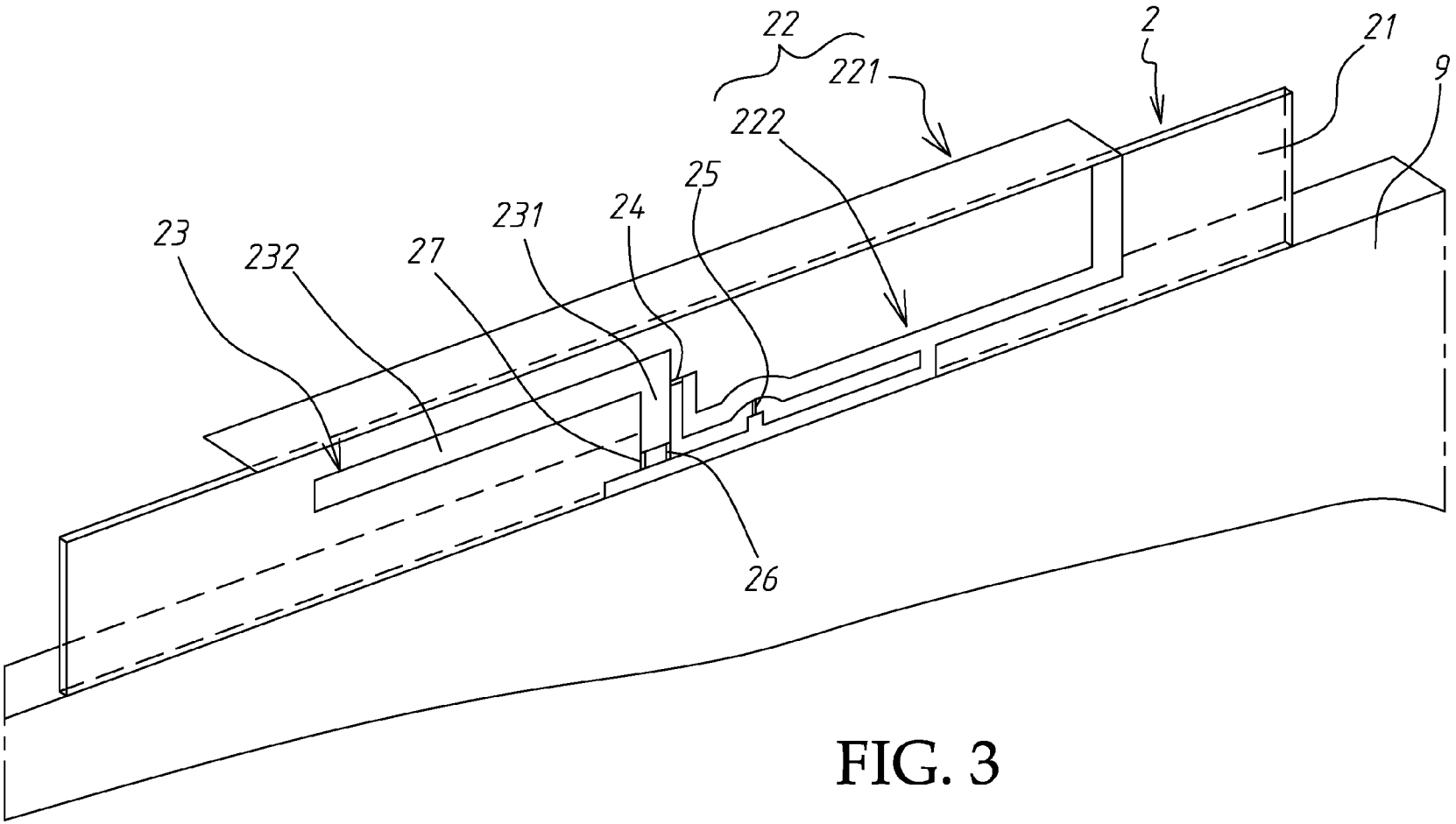
FIG. 3 is a perspective view showing a multi-band antenna installed in a display screen for notebook computer in accordance with a second embodiment of the present invention.

FIG. 3 illustrates a multi-band antenna 2 for notebook computer in accordance with a second embodiment of the present invention. The multi-band antenna 2 is mounted on the top side of a notebook computer's display screen 9 to receive and transmit radio signals. The multi-band antenna 2 comprises an electrically insulative carrier board 21, a main antenna 22, an inverted L antenna 23, a first capacitor 24, a second capacitor 25, an antenna feed-in terminal 26 and an inductor 27.

Figure 4:
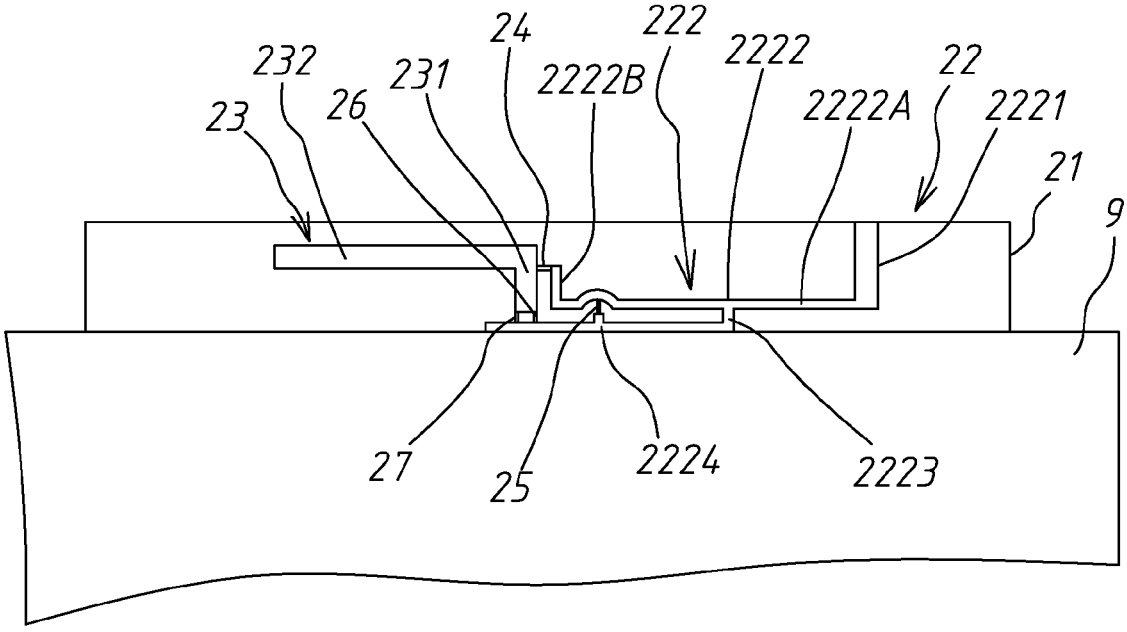
FIG. 4 is a plain view of the multi-band antenna in accordance with the second embodiment of the present invention.

Referring to FIG. 4 and FIG. 3 again, the main antenna 22 comprises a top metal strip 221 and a grounding metal strip 222. The top metal strip 221 is disposed at the top side of the electrically insulative carrier board 21. The grounding metal strip 222 is arranged on the electrically insulative carrier board 21, having a top end portion 2221 connected to the top metal strip 221, a L-shaped body portion 2222 extended from one end of the top end portion 2221 remote from the top metal strip 221, a connection portion 2223 extended from a middle part of the longitudinal axis 2222A of the L-shaped body portion 2222 and a grounding portion 2224 extended from one end of the connection portion 2223 remote from the L-shaped body portion 2222 and connected to the display screen 9 and grounded. The display screen 9 serves as a grounding plane.

The inverted L antenna 23 is also arranged on the electrically insulative carrier board 21, having the transverse axis 231 thereof disposed at one lateral side relative to the transverse axis 2222B of the L-shaped body portion 2222 of the grounding metal strip 222 of the main antenna 22 at one lateral side and the longitudinal axis 232 thereof kept in parallel to the top metal strip 221 of the main antenna 22.

The first capacitor 24 is electrically connected between the transverse axis 231 of the inverted L antenna 23 and the transverse axis 2222B of the L-shaped body portion 2222 of the grounding metal strip 222 of the main antenna 22. The second capacitor 25 is electrically connected between the longitudinal axis 2222A of the L-shaped body portion 2222 of the grounding metal strip 222 of the main antenna 22 and the grounding portion 2224 of the grounding metal strip 222 of the main antenna 22. Further, the antenna feed-in terminal 26 is located on the distal end of the transverse axis 231 of the inverted L antenna 23. Further, the inductor 27 is electrically connected between the distal end of the transverse axis 231 of the inverted L antenna 23 and the grounding portion 2224 of the grounding metal strip 222 of the main antenna 22.

During operation of the multi-band antenna 2, a radio signal is inputted through the antenna feed-in terminal 26 into the inverted L antenna 23 and then transferred by the first capacitor 24 to the distal end of the longitudinal axis 2222A of the L-shaped body portion 2222 of the grounding metal strip 222 of the main antenna 22.

Further, in the multi-band antenna 2, the second capacitor 25 can be moved between the longitudinal axis 2222A of the L-shaped body portion 2222 of the grounding metal strip 222 and the grounding portion 2224 to find the best position for optimal matching with the multi-band antenna 2.

Further, in the multi-band antenna 2, the capacitance values and positions of the first capacitor 24 and second capacitor 25 and the inductance value of the inductor 27 are adjustable to achieve optimal matching with the multi-band antenna 2.

Figure 5:
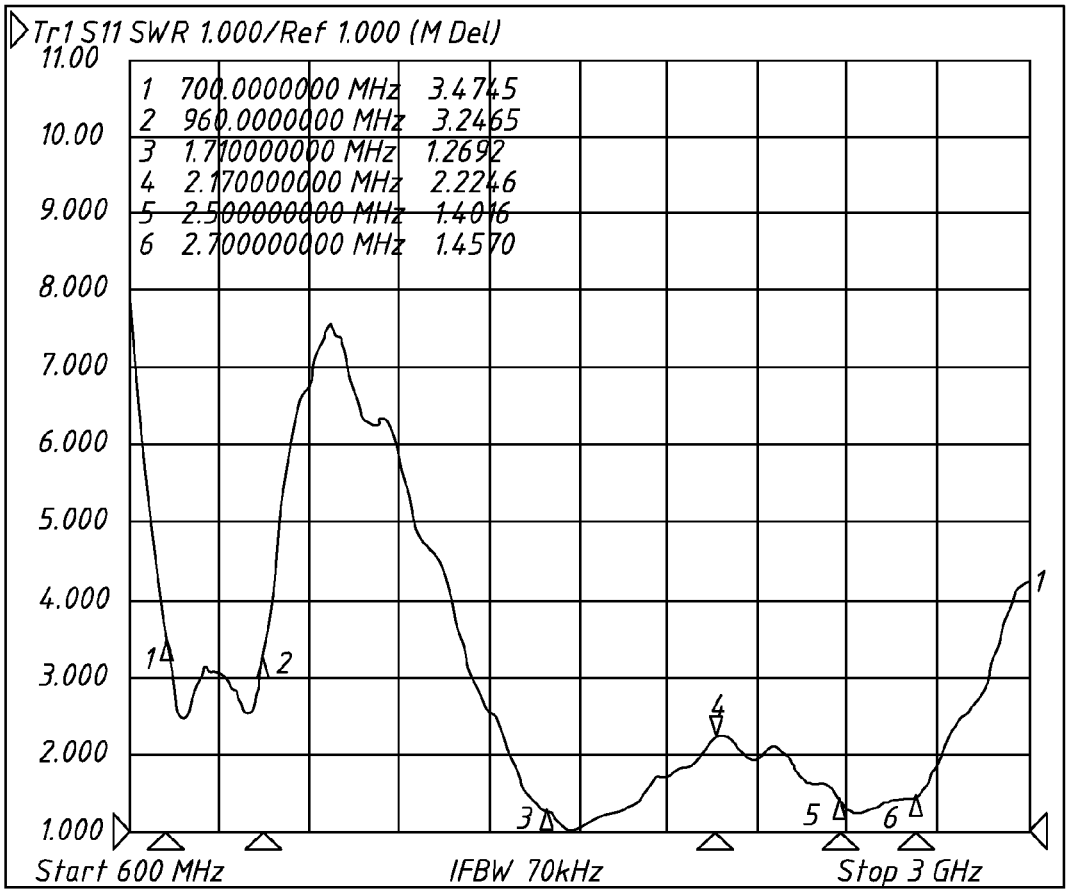
FIG. 5 is a SWR chart obtained from the multi-band antenna in accordance with the second embodiment of the present invention.

FIG. 5 illustrates the SWR (Standing Wave Ratio) of the multi-band antenna 2 of the second embodiment of the present invention. The multi-band antenna 2 has the following working frequencies:

1. 700 MHz~960 MHz.
2. 1710 MHz~2170 MHz.
3. 2500 MHz~2700 MHz.

Further, the size of the multi-band antenna 2 in accordance with the second embodiment is about 10 mm shorter than the multi-band antenna 2 in accordance with the first embodiment.

The electrically insulative carrier board 11 or 21 can be made in any configuration for antenna fixation. The shape and type of the electrically insulative carrier board 11 or 21 are similar to those commonly known. No further illustration in this regard is necessary.

Figure 6:
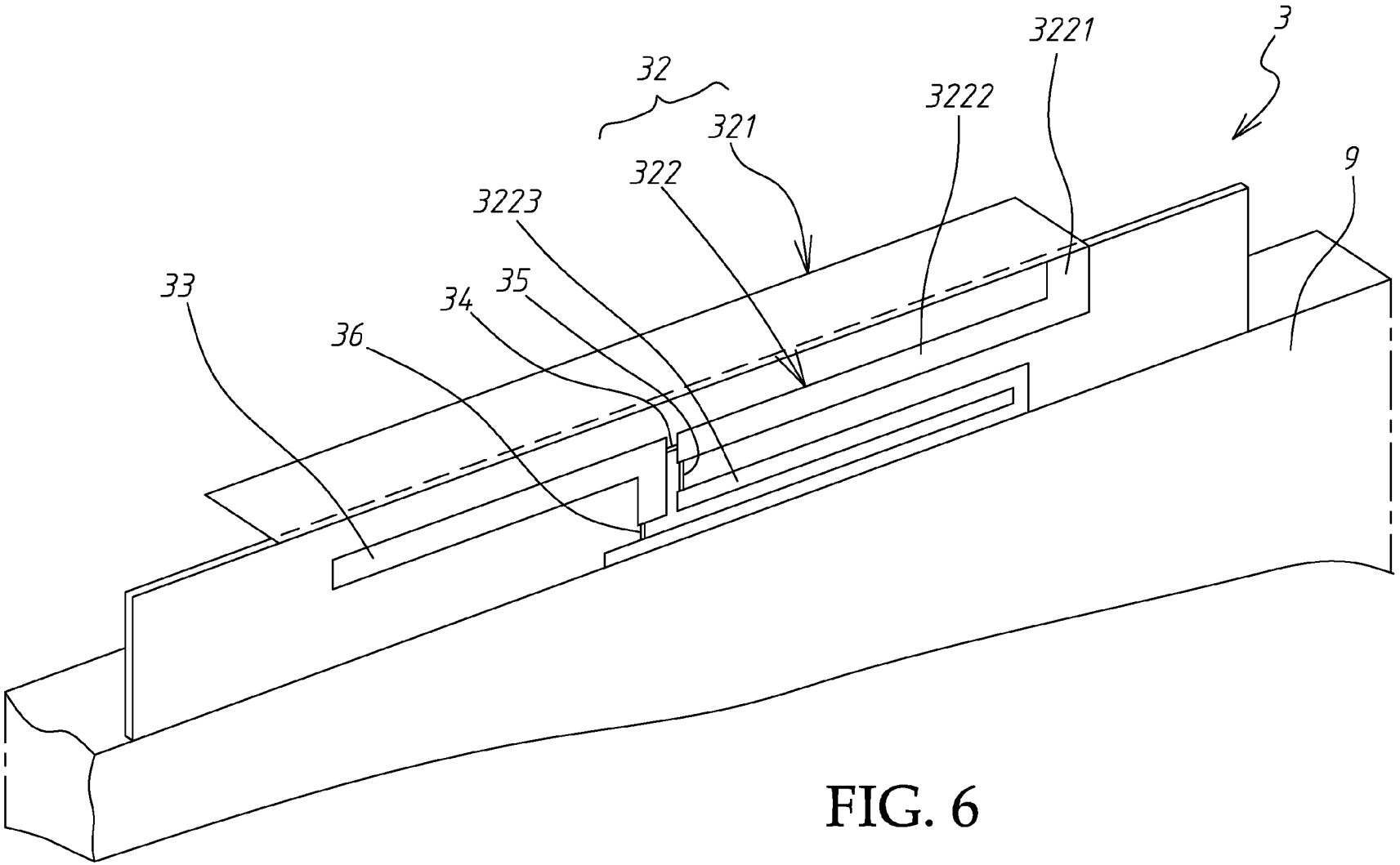
FIG. 6 is a perspective view showing a multi-band antenna installed in a display screen for notebook computer in accordance with a third embodiment of the present invention.

FIG. 6 illustrates a multi-band antenna 3 for notebook computer in accordance with a third embodiment of the present invention. The multi-band antenna 3 is shown mounted on the top side of a notebook computer's display screen 9 for receiving and transmitting radio signals. The multi-band antenna 3 comprises an electrically insulative carrier board 31, a main antenna 32, an inverted L antenna 33, a first capacitor 34, a variable component 35 and an antenna feed-in terminal 36.

Figure 7:
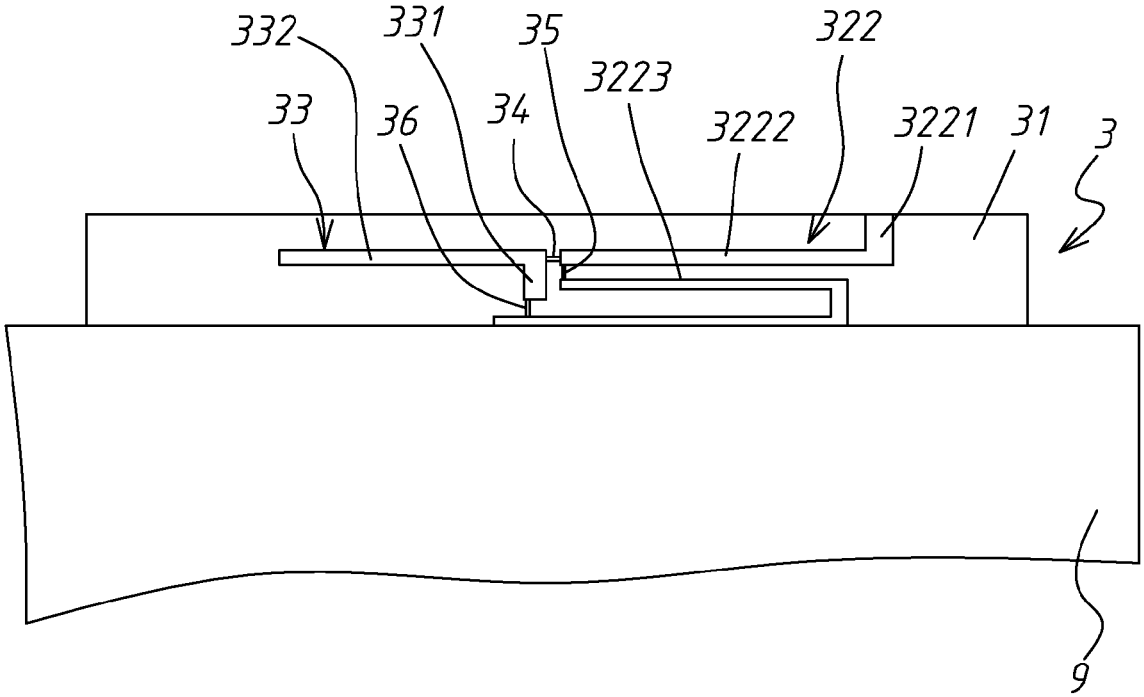
FIG. 7 is a plain view of the multi-band antenna in accordance with the third embodiment of the present invention.

Referring to FIG. 7 and FIG. 6 again, the electrically insulative carrier board 31 is arranged on the top side of the display screen 9. The main antenna 32 comprises a top metal strip 321 and a grounding metal strip 322. The top metal strip 321 is disposed at the top side of the electrically insulative carrier board 31. The grounding metal strip 322 is arranged on the electrically insulative carrier board 31, having a top end portion 3221 connected to the top metal strip 321, a narrow elongated body portion 3222 extended from one end of the top end portion 3221 remote from the top metal strip 321, and a reversely disposed ⊏-shaped grounding portion 3223 connected to the display screen 9 and grounded. The distal end of the narrow elongated body portion 3222 is connected to the reversely disposed ⊏-shaped grounding portion 3223 by the variable component 35. The display screen 9 serves as a grounding plane.

The inverted L antenna 33 is also arranged on the electrically insulative carrier board 31, having the transverse axis 331 thereof disposed at one lateral side of the distal end of the narrow elongated body portion 3222 and the longitudinal axis 332 thereof disposed in parallel to the top metal strip 321.

The first capacitor 34 is electrically connected between the transverse axis 331 of the inverted L antenna 33 and the distal end of the narrow elongated body portion 3222. The variable component 35 is electrically connected between the distal end of the narrow elongated body portion 3222 and the reversely disposed ⊏-shaped grounding portion 3223. Further, the antenna feed-in terminal 36 is located on the distal end of the transverse axis 331 of the inverted L antenna 33.

During operation of the multi-band antenna 3, a radio signal is inputted through the antenna feed-in terminal 36 into the inverted L antenna 33 and then transferred by the first capacitor 34 to the distal end of the narrow elongated body portion 3222 of the grounding metal strip 322 of the main antenna 32. The first capacitor 34 and the variable component 35 can match the multi-band antenna 3. The variable component 35 is adapted to adjust the resonant point. Further, the variable component 35 can be a variable inductor or variable capacitor.

Further, in the multi-band antenna 3, the variable component 35 can be moved leftwards or rightwards between the narrow elongated body portion 3222 of the grounding metal strip 322 and the reversely disposed ⊏-shaped grounding portion 3223 to adjust the impedance matching of the antenna. Using a different first capacitor 34 having a different capacitance value can achieve the same effect. By means of utilizing the variable characteristic of the variable component 35, the resonant point of the multi-band antenna is adjustable.

Figure 8:
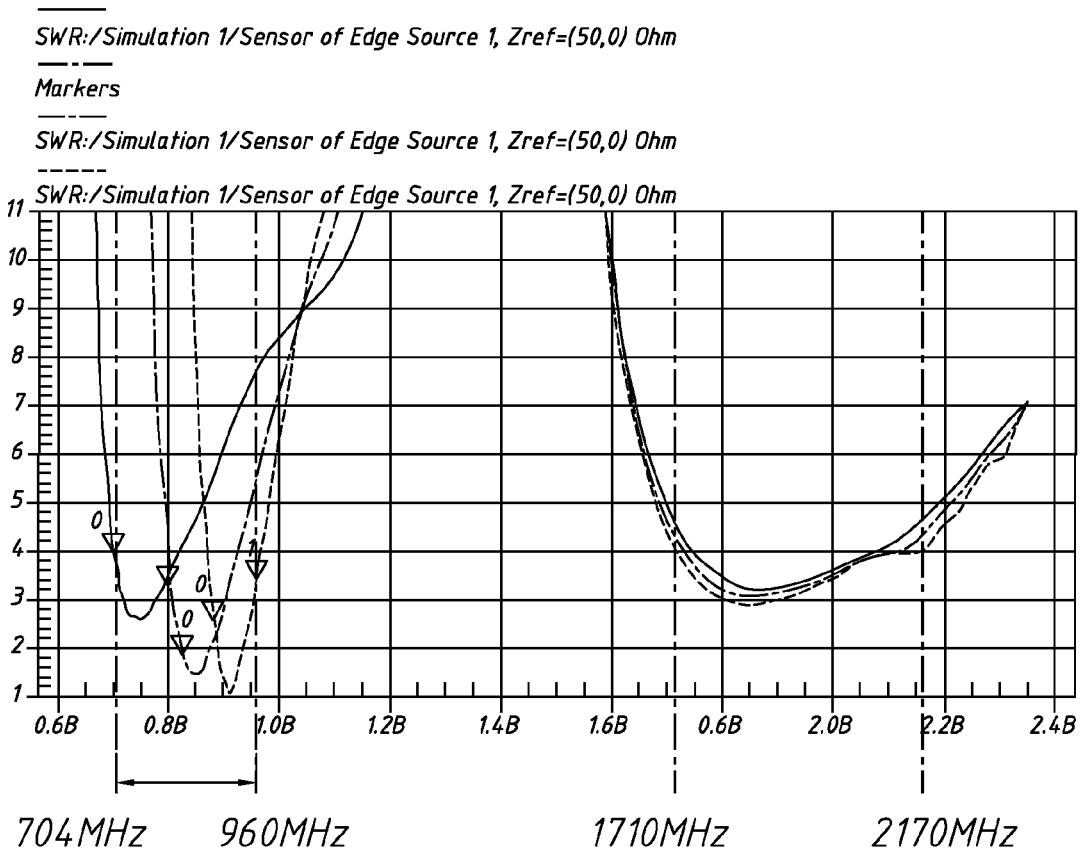
FIG. 8 is a SWR chart obtained from the multi-band antenna in accordance with the third embodiment of the present invention.

FIG. 8 illustrates the SWR (Standing Wave Ratio) of the multi-band antenna 3 in accordance with the third embodiment of the present invention. As stated above, the multi-band antenna 3 utilizes the variable characteristic of the variable component to achieve LTE (Long Term Evolution) frequency band, and the variable frequency range covers 704 MHz~960 MHz.

In conclusion, the invention has capacitor/inductor means built in the multi-band antenna so that antenna matching can be achieved by means of adjusting the value and position of the capacitor/inductor means without an extra matching circuit, and antenna dimension can be greatly reduced.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A multi-band antenna mounted on a display screen of a notebook computer for receiving and transmitting radio signals, the multi-band antenna comprising:

an electrically insulative carrier board mounted on a top side of said display screen;

a main antenna, said main antenna comprising a top metal strip disposed at a top side of said electrically insulative carrier board and a grounding metal strip arranged on said electrically insulative carrier board, said grounding metal strip having a top end portion connected to said top metal strip, a L-shaped body portion extended from said top end portion, said L-shaped body portion having a longitudinal axis and a transverse axis, a curved portion extended from a middle part of the longitudinal axis of said L-shaped body portion and a grounding portion extended from one end of said curved portion remote from said L-shaped body portion and connected to said display screen and grounded;

an inverted L antenna arranged on said electrically insulative carrier board, said inverted L antenna having a transverse axis disposed at one lateral side relative to the transverse axis of said L-shaped body portion of said grounding metal strip and a longitudinal axis disposed in parallel to said top metal strip;

a first capacitor electrically connected between the transverse axis of said inverted L antenna and the transverse axis of said L-shaped body portion of said grounding metal strip of said main antenna;

a second capacitor electrically connected between a distal end of the transverse axis of the L-shaped body portion of said grounding metal strip of said main antenna and the transverse axis of said grounding portion of said grounding metal strip of said main antenna; and an antenna feed-in terminal located on a distal end of the transverse axis of said inverted L antenna;

wherein a radio signal is inputted through said antenna feed-in terminal into said inverted L antenna and then transferred by said first capacitor to a distal end of the longitudinal axis of said L-shaped body portion of said grounding metal strip of said main antenna; said first capacitor and said second antenna provide an antenna matching function; the position of said first capacitor is vertically adjustable to match the multi-band antenna.

2. The multi-band antenna as claimed in claim 1, wherein the connection between the top end of said curved portion of said grounding metal strip of said main antenna and the longitudinal axis of said L-shaped body portion is movable to match the multi-band antenna for inductance grounding.

3. The multi-band antenna as claimed in claim 1, wherein the capacitance value and position of each of said first capacitor and said second capacitor and the connection position between the top end of said curved portion of said grounding metal strip of said main antenna and the longitudinal axis of said L-shaped body portion are adjustable to achieve optimal antenna match.

4. A multi-band antenna mounted on a display screen of a notebook computer for receiving and transmitting radio signals, the multi-band antenna comprising:

an electrically insulative carrier board mounted on a top side of said display screen;

a main antenna, said main antenna comprising a top metal strip disposed at a top side of said electrically insulative carrier board and a grounding metal strip arranged on said electrically insulative carrier board, said grounding metal strip having a top end portion connected to said top metal strip, a L-shaped body portion extended from one end of said top end portion remote from said top metal strip, said L-shaped body portion having a longitudinal axis and a transverse axis, a connection portion extended from a middle part of the longitudinal axis of said L-shaped body portion and a grounding portion extended from one end of said connection portion remote from said L-shaped body portion and connected to said display screen and grounded;

an inverted L antenna arranged on said electrically insulative carrier board, said inverted L antenna having a transverse axis disposed at one lateral side relative to said L-shaped body portion of said grounding metal strip and a longitudinal axis disposed in parallel to said top metal strip;

a first capacitor electrically connected between the transverse axis of said inverted L antenna and a distal end of the transverse axis of said L-shaped body portion of said grounding metal strip;

a second capacitor electrically connected between the longitudinal axis and grounding portion of said grounding metal strip;

an antenna feed-in terminal located on a distal end of the transverse axis of said inverted L antenna; and an inductor connected between the distal end of the transverse axis of said inverted L antenna and a distal end of the grounding portion of said grounding metal strip;

wherein a radio signal is inputted through said antenna feed-in terminal into said inverted L antenna and then transferred by said first capacitor to the distal end of the longitudinal axis of said L-shaped body portion of said grounding metal strip of said main antenna; said first capacitor, said second capacitor and said inductor provide an antenna matching function; the position of said first capacitor is vertically adjustable to match the multi-band antenna.

5. The multi-band antenna as claimed in claim 4, wherein said second capacitor is movable between the longitudinal axis of the L-shaped body portion of said grounding metal strip and said grounding portion to find the best position for optimal matching.

6. The multi-band antenna as claimed in claim 4, wherein the capacitance values and positions of said first capacitor and said second capacitor and the inductance value of said inductor are adjustable to achieve optimal matching with the multi-band antenna.

7. A multi-band antenna mounted on a display screen of a notebook computer for receiving and transmitting radio signals, the multi-band antenna comprising:

an electrically insulative carrier board mounted on a top side of said display screen;

a main antenna, said main antenna comprising a top metal strip disposed at a top side of said electrically insulative carrier board and a grounding metal strip arranged on said electrically insulative carrier board, said grounding meal strip having a narrow elongated body portion connected to said top metal strip and a reversely disposed ⊏-shaped grounding portion connected to said display screen and grounded;

an inverted L antenna arranged on said electrically insulative carrier board, said inverted L antenna having a transverse axis disposed at one lateral side of said narrow elongated body portion of said grounding metal strip and a longitudinal axis disposed in parallel to said top metal strip;

a first capacitor electrically connected between the transverse axis of said inverted L antenna and a distal end of said narrow elongated body portion of said grounding meal strip;

a variable component electrically connected between the distal end of said narrow elongated body portion of said grounding metal strip and said reversely disposed ⊏-shaped grounding portion of said main antenna; and an antenna feed-in terminal located on a distal end of the transverse axis of said inverted L antenna;

wherein a radio signal is inputted through said antenna feed-in terminal into said inverted L antenna and then transferred by said first capacitor to the distal end of said narrow elongated body portion of said grounding metal strip of said main antenna; said first capacitor and said variable component provide an antenna matching function; said variable component is adapted for resonant point adjustment.

8. The multi-band antenna as claimed in claim 7, wherein said variable component is movable leftwards and rightwards between said narrow elongated body portion of said grounding metal strip and said reversely disposed ⊏-shaped grounding portion to adjust the impedance matching of the multi-band antenna.

9. The multi-band antenna as claimed in claim 7, wherein said variable component is a variable inductor.

10. The multi-band antenna as claimed in claim 7, wherein said variable component is a variable capacitor.

* * * * *